US012768629B2

(12) United States Patent
Wright

(10) Patent No.: US 12,768,629 B2
(45) Date of Patent: Oct. 20, 2026

(54) MULTI-ATMOSPHERIC SAFE FIRING CONTROL CIRCUIT FOR WIRELESS DETONATORS AND INITIATORS

(71) Applicant: Down Range Systems LLC, Bell Buckle, TN (US)

(72) Inventor: Ronnie Wright, Bell Buckle, TN (US)

(73) Assignee: Down Range Systems LLC, Bell Buckle, TN (US)

( * ) Notice: Subject to any disclaimer, the term of this patent is extended or adjusted under 35 U.S.C. 154(b) by 0 days.

(21) Appl. No.: 19/293,108

(22) Filed: Aug. 7, 2025

(65) Prior Publication Data

US 2026/0185811 A1 Jul. 2, 2026

Related U.S. Application Data

(60) Provisional application No. 63/740,143, filed on Dec. 30, 2024.

(51) Int. Cl.

| | |
|---|---|
| ***F42C 11/00*** | (2006.01) |
| ***F42B 3/18*** | (2006.01) |
| ***F42C 13/04*** | (2006.01) |
| ***F42C 15/42*** | (2006.01) |
| ***F42D 1/04*** | (2006.01) |
| ***F42D 1/05*** | (2006.01) |
| ***F42D 1/055*** | (2006.01) |
| ***F42D 5/00*** | (2006.01) |

(52) U.S. Cl.

CPC ..... *F42C 15/42* (2013.01); *F42B 3/18* (2013.01); *F42C 11/00* (2013.01); *F42C 13/04* (2013.01); *F42D 1/042* (2013.01); *F42D 1/05* (2013.01); *F42D 1/055* (2013.01); *F42D 5/00* (2013.01)

(58) Field of Classification Search

CPC . F42D 1/04; F42D 1/042; F42D 1/045; F42D 1/05; F42D 1/055; F42D 5/00; F42C 11/00; F42C 11/001; F42C 13/04; F42C 15/40; F42C 15/42; F42B 3/10; F42B 3/18

USPC ..... 102/202.1–202.4, 206, 218, 219

See application file for complete search history.

(56) References Cited

U.S. PATENT DOCUMENTS

| | | | | |
|---|---|---|---|---|
| 6,298,924 | B1 * | 10/2001 | Vaynshteyn | E21B 43/11857 175/4.54 |
| 7,810,430 | B2 * | 10/2010 | Chan | F42B 3/121 102/214 |
| 10,267,611 | B2 * | 4/2019 | Lownds | F42D 5/00 |
| 11,441,883 | B2 * | 9/2022 | Maurissens | F42D 1/02 |

* cited by examiner

*Primary Examiner* — James S Bergin

(74) *Attorney, Agent, or Firm* — Fish & Richardson P.C.

(57) ABSTRACT

A multi-atmospheric safe firing control circuit for wireless detonators and initiators is disclosed. A low-voltage switch can transition from an open state to a closed state. An oscillating circuit activates when the low-voltage switch transitions to the closed state and the oscillating circuit provides alternating current to primary coils of a transformer. A doubling circuit coupled to a capacitor receives direct current from secondary coils of the transformer and multiples voltage for storage in the capacitor. A gas discharge tube coupled to the capacitor acts as a high-voltage switch by completing a voltage transfer from the capacitor to coupled electrical contacts upon reaching a preset voltage threshold.

8 Claims, 13 Drawing Sheets

Form factor

Controller:

4.9 inches in length x 2.5 inches in width x one 1.1 inch in height

.18" Sharp reflective display (LS018B7DH02), 230 x 302 resolution with extremely low power consumption.

2x CR123A battery powered 3 input buttons for receiver selection and manipulation Safety slider covers FIRE buttons preventing premature detonation of selected receivers Safety cover also covers the input buttons when the FIRE button is exposed preventing unintended manipulation of the input buttons.

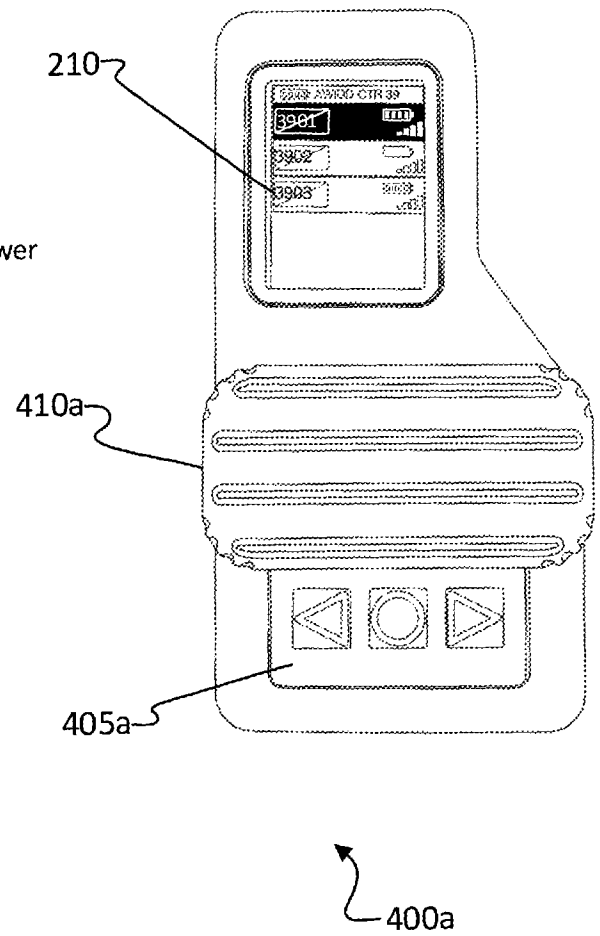

FIG. 4A

Form factor

Receiver:

3.0 inches in length x 2.0 inches in width x 1.28 inch in height

Top slider protects POWER button (press and hold both buttons for 3 seconds).

Dual push connector allowing 3mm shock tube to be installed. Each receiver has two shock tube connectors allowing duel priming.

10° Red LED indicator identifying if powered on and or armed.

MULTI-ATMOSPHERIC SAFE FIRING CONTROL CIRCUIT FOR WIRELESS DETONATORS AND INITIATORS

CROSS-REFERENCE TO RELATED APPLICATIONS

This application claims the benefit of U.S. Provisional Application No. 63/740,143, filed on Dec. 30, 2024, the entire contents of which are incorporated by reference in its entirety.

BACKGROUND

Given known hazards associated with initiation of explosives, wireless detonation systems are generally accepted as a means of mitigating risk associated with connecting blasting caps and/or ignition devices to a primary explosive charge. However, existing wireless initiation receivers implement safety features that require additional components to ensure enhanced safety. The additional components can be bulky, add weight, require a high power draw, and increase overall cost.

SUMMARY

The present disclosure describes multi-atmospheric safe firing control circuit for wireless detonators and initiators.

In an implementation, a multi-atmospheric safe firing control circuit for wireless detonators and initiators, comprises: a low-voltage switch, wherein the low-voltage switch can transition from an open state to a closed state; an oscillating circuit, wherein the oscillating circuit activates when the low-voltage switch transitions to the closed state, and wherein the oscillating circuit provides alternating current to primary coils of a transformer; a doubling circuit coupled to a capacitor, wherein the doubling circuit receives direct current from secondary coils of the transformer, and wherein the doubling circuit multiples voltage for storage in the capacitor; and a gas discharge tube coupled to the capacitor, wherein the gas discharge tube acts as a high-voltage switch by completing a voltage transfer from the capacitor to coupled electrical contacts upon reaching a preset voltage threshold.

The subject matter described in this specification can be implemented to realize one or more of the following advantages. First, the described approach includes fewer bulky components which saves both weight and cost. Second, the described approach conserves and reduces operational power requirements. Third, the described approach provides a reliable means to wirelessly initiate explosives. Fourth, the described approach is safe in all environmental and climactic conditions.

Some of the described subject matter can be implemented using a computer-implemented method; a non-transitory, computer-readable medium storing computer-readable instructions to perform the computer-implemented method; and/or a computer-implemented system comprising one or more computer memory devices interoperably coupled with one or more computers and having tangible, non-transitory, machine-readable media storing instructions that, when executed by the one or more computers, perform the computer-implemented method/the computer-readable instructions stored on the non-transitory, computer-readable medium.

The details of one or more implementations of the subject matter of this specification are set forth in the Detailed Description, the Claims, and the accompanying drawings. Other features, aspects, and advantages of the subject matter will become apparent to those of ordinary skill in the art from the Detailed Description, the Claims, and the accompanying drawings.

DESCRIPTION OF DRAWINGS

FIG. 4A is an image of a controller and description of the controller form factor, according to an implementation of the present disclosure.

Like reference numbers and designations in the various drawings indicate like elements.

DETAILED DESCRIPTION

The following detailed description describes a multi-atmospheric safe firing control circuit for wireless detonators and initiators and is presented to enable any person skilled in the art to make and use the disclosed subject matter in the context of one or more particular implementations. Various modifications, alterations, and permutations of the disclosed implementations can be made and will be readily apparent to those of ordinary skill in the art, and the general principles defined can be applied to other implementations and applications, without departing from the scope of the present disclosure. In some instances, one or more technical details that are unnecessary to obtain an understanding of the described subject matter and that are within the skill of one of ordinary skill in the art may be omitted so as to not obscure one or more described implementations. The present disclosure is not intended to be limited to the described or illustrated implementations, but to be accorded the widest scope consistent with the described principles and features.

Given known hazards associated with initiation of explosives, wireless detonation systems are generally accepted as a means of mitigating risk associated with connecting blasting caps and/or ignition devices to an explosive charge (e.g., providing extended standoff distances from the explosive charge). However, existing wireless initiation receivers implement safety features that require additional components to ensure enhanced safety. The additional components can be bulky, add weight, require a high power draw, and increase overall cost.

The described approach overcomes negative aspects of existing wireless initiation receivers by including fewer bulky components, which saves both weight and cost. Operational power requirements are also reduced. Accordingly, a safe means to wirelessly initiate explosives is provided which is safe in all environmental and climactic conditions.

At a high-level, the described approach includes a wireless detonator that contains a radio module that sends a wireless fire command from a controller to a receiver. The receiver receives the fire command from the controller and activates an oscillating circuit that receives direct current (DC) voltage from a battery. An alternating current (AC) source to primary coils of a transformer in the oscillating circuit is supplied by secondary coils of the transformer as DC voltage to a doubling circuit in a voltage controller switch. The doubling circuit continues to multiply the DC voltage from the secondary coils of the transformer and to store energy in a capacitor. Once a threshold of a gas discharge tube is reached, a voltage transfer occurs across the gas discharge tube. That is, energy stored in the capacitor is released across electrical contacts (e.g., across a spark gap probe connected to the electrical contacts). The electrical contacts can be connected to an electrical/non-electrical detonator or initiator.

Figure 1:
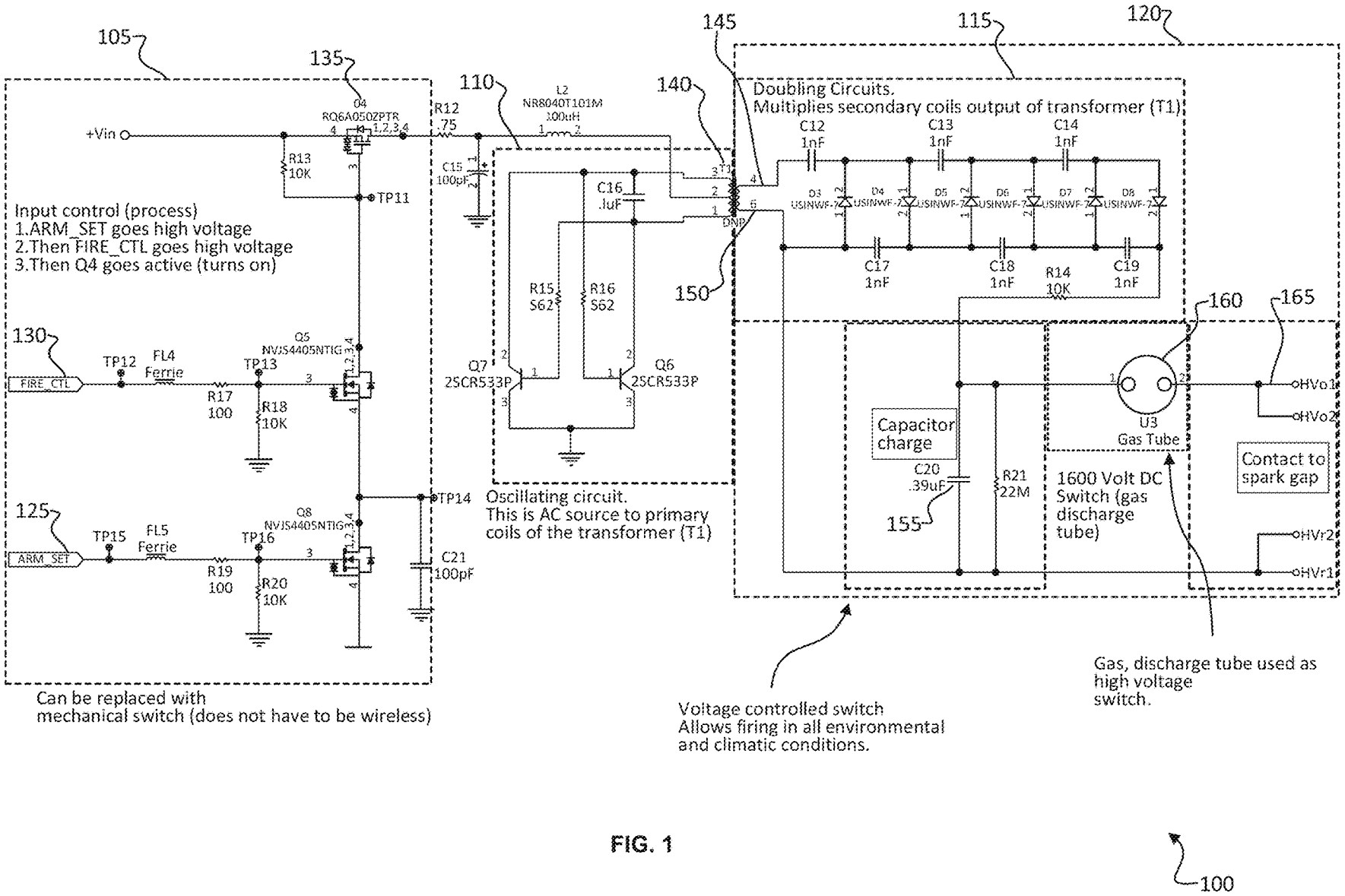
FIG. 1 is a circuit diagram of a multi-atmospheric safe firing control circuit for wireless detonators and initiators, according to an implementation of the present disclosure.

Turning to FIG. 1, FIG. 1 is a circuit diagram 100 of a multi-atmospheric safe firing control circuit for wireless detonators and initiators, according to an implementation of the present disclosure. FIG. 1 illustrates an input control 105, oscillating circuit 110, doubling circuits 115, and voltage controlled switch 120 which is contained in a receiver component of wireless detonation device for explosives.

In some implementations, an input control 105 process includes: 1) ARM_SET 125 goes high-voltage; 2) FIRE_CTRL 130 goes high-voltage; and 3). Transistor Q4 135 goes active (turns ON) supplying power to the oscillating circuit 110. In some implementations, the oscillating circuit receives 1.5V to 4V of direct current (DC) from a battery. In some implementations, input control 105 can be replaced with a mechanical switch(es) and does not have to be a wireless implementation.

Oscillating circuit 110 provides alternating current (AC) to primary coils of transformer T1 140. Transformer T1 140 provides DC current on secondary coils to leads 4 and 5 (145 and 150, respectively) to the doubling circuits 115.

Doubling circuits 115 multiplies DC output of the secondary coils of transformer T1 140. Capacitor C20 155 is increasingly charged by the doubling circuits 115.

The voltage controlled switch 120 includes a gas discharge tube 160. A gas discharge tube is typically used to provide transient surge protection in small devices and is designed to dissipate large amounts of energy. For example, gas discharge tubes can be used to protect circuits from lightning and electrical surge events. A common usage is in outdoor telecom equipment to protect circuits on cell phone towers from lightning strikes.

Here, gas discharge tube 160 is instead being reutilized as a high-voltage safety switch as part of the voltage controlled switch 120. In other words, when used as described and in an application to initiate detonation of an explosive, the gas discharge tube 160 can be used to ensure that electrical energy is not inadvertently/accidentally transmitted to electrical contacts 165.

The electrical contacts 165 can be used to initiate an electrical detonator or initiator (e.g., an electrical blasting cap). In some implementations, the electrical contacts 165 are connected to spark gap probes which can electrically generate a plasma arc between a cathode and anode used to ignite a non-electrical shock tube (e.g., a NONEL shock tube). In some implementations, there can be multiple electrical contacts 165 (e.g., two), to permit multi-priming applications (i.e., the use of two blasting caps or two shock tubes).

As energy is not dissipated by a gas discharge tube until a high-voltage DC state is reached (e.g., 1600V), stray or low voltage energy will not traverse the gas discharge tube 160 to reach the electrical contacts 165 without a deliberate activation of the described voltage controlled switch 120. The safety provided by the voltage controlled switch 120 allows for use of the multi-atmospheric safe firing control circuit for wireless detonators and initiators in all environmental and climactic conditions. Once the threshold of the gas discharge tube is reached, the gas discharge tube completes a transfer of all voltage stored in the coupled capacitor to the electrical contacts 165. The doubling circuit continues to charge the capacitor. In some implementations, each time the wireless fire command is transmitted to the receiver it will charge the capacitor for three seconds. Within the three seconds, the spark gap of the spark gap probe will fire five to six times (allowing for tolerance in the transformer, capacitor, and gas discharge tube).

Figure 2:
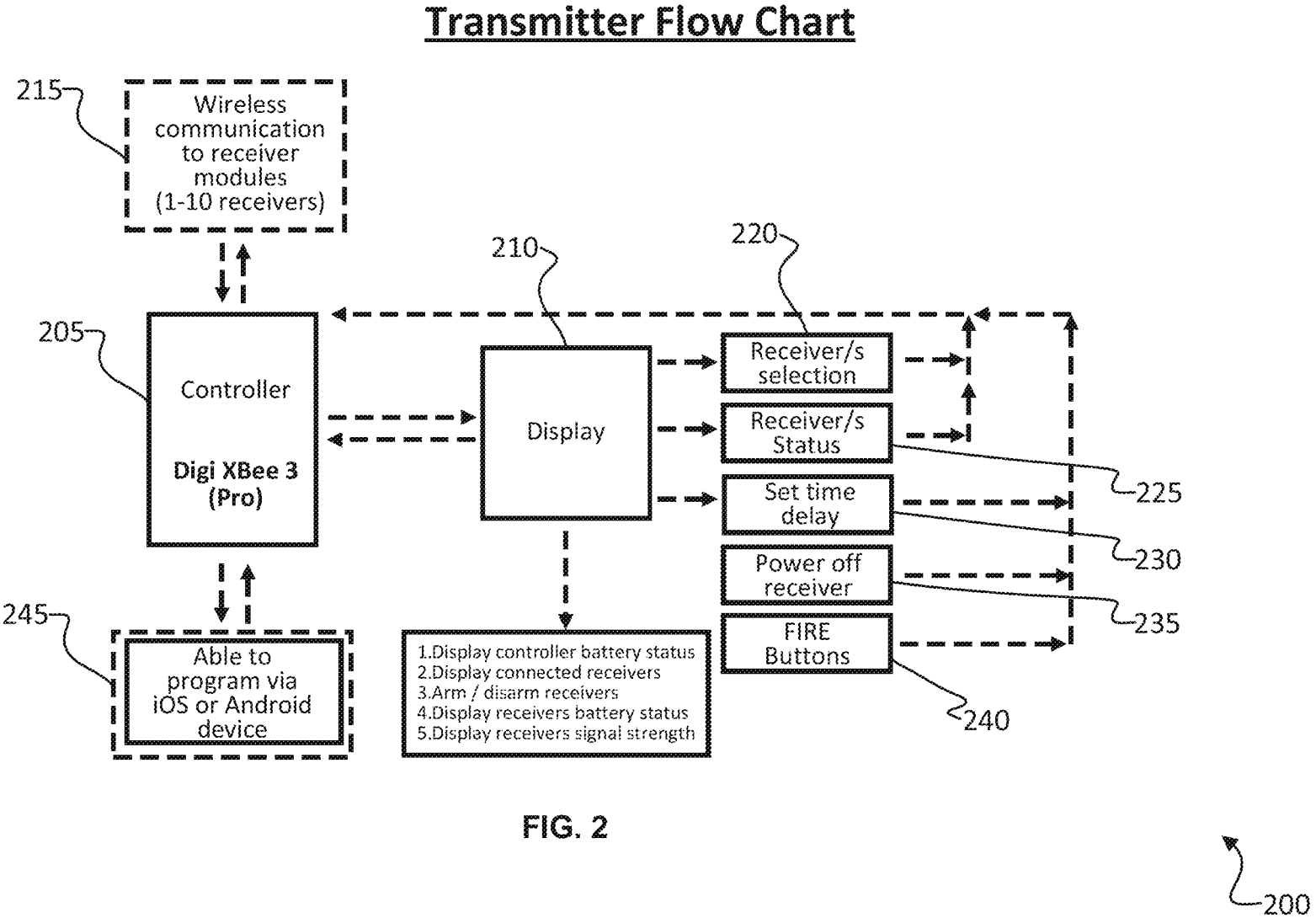
FIG. 2 is a block diagram of a transmitter flow chart, according to an implementation of the present disclosure.

FIG. 2 is a block diagram of a transmitter flow chart 200, according to an implementation of the present disclosure. The transmitter flow chart 200 includes a controller 205 (e.g., a Digi XBee 3 (Pro) system on a chip (SoC)) and display 210.

In some implementations, the controller 205 is configured to pair with up receiver modules (receivers) 215 (e.g., ten (10)) simultaneously using a wireless multi-modal, uniquely encrypted connections. Receivers 215 can be paired to the controller 205 as needed for follow-on operations.

Figure 3:
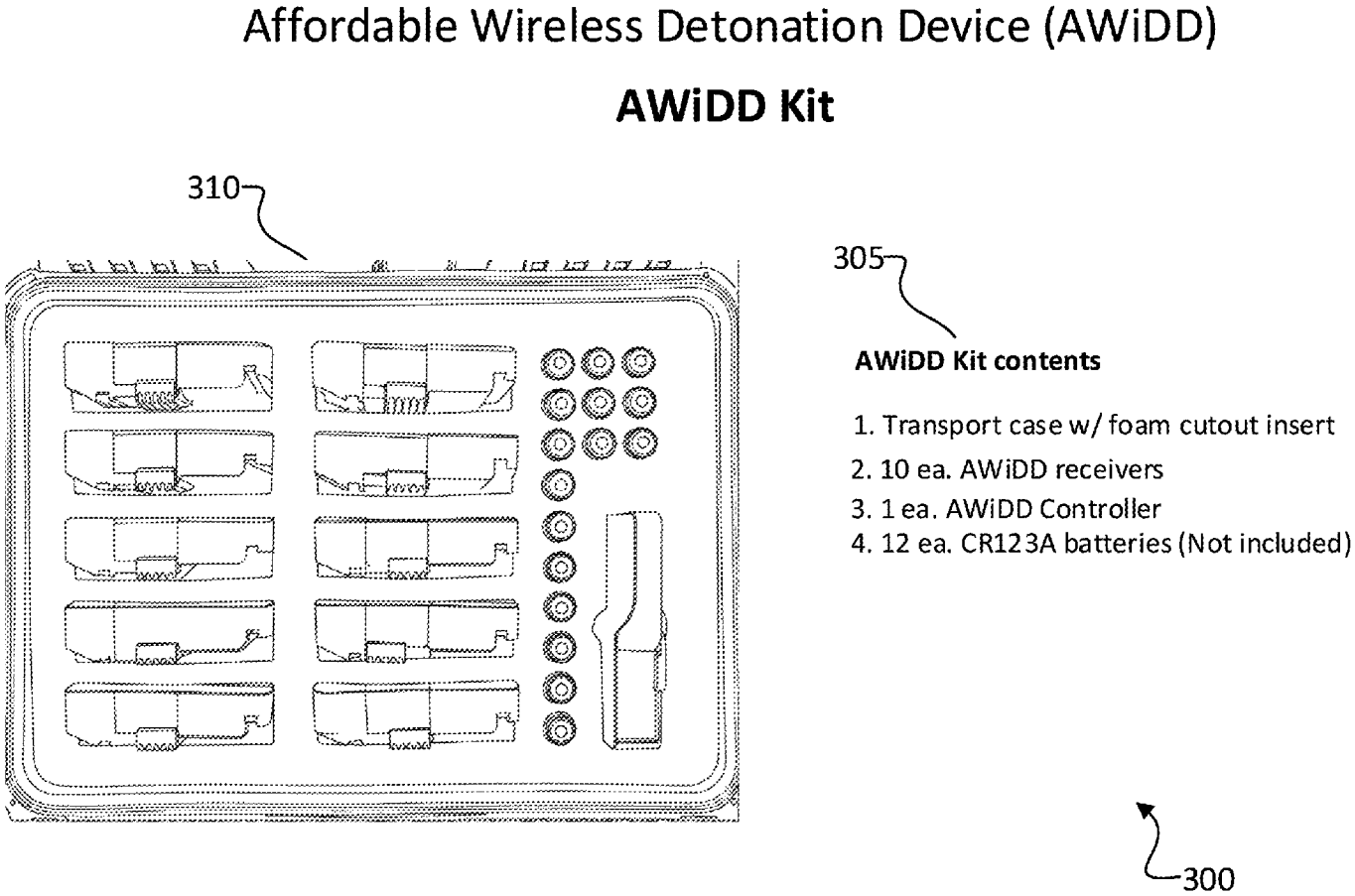
FIG. 3 is an image of an implementation an affordable wireless detonation device (AWiDD) kit, according to some implementations of the present disclosure.

Turning briefly to FIG. 3, FIG. 3 is an image of an implementation an affordable wireless detonation device (AWiDD) kit 300, according to some implementations of the present disclosure.

In some implementations, each AWiDD kit contents 305 can include a transport case with foam cutout insert, 10× AWiDD receivers, 1× AWiDD controller, and 12× CR123A batteries. A portion of the transport case with foam cutout insert 310 is shown.

Each AWiDD kit 300 is delivered with a kit-unique encryption key. An end user can later change, add, and/or configure a unique encryption key if desired.

Returning to FIG. 2, in some implementations, controller 205 can include a radio frequency (RF) module. In typical implementations, controller 205 is capable of transmitting in complex, urban, high-noise RF environments and detonating Non-Line of Sight (NLOS) range is 300 ft. (90 meters) utilizing the current Pro version of the radio module. Detonating Line of Sight (LOS) range is 3200 meters utilizing the current "Pro" version of the radio module.

AWiDD receivers build a mesh network, so adding "drops" enables the overall system to overcome NLOS obstacles. "Drop" receivers only need to be powered on to act as mesh relays, which enables extended ranges especially in complex structures and subterranean environments.

In some implementations, the controller 205 has a built-in chip antenna. For best antenna performance the controller 205 should be utilized with the back of the controller parallel with the ground.

In some implementations, the RF module is configured with shielding to protect against RF interference. RF jammers within the vicinity of the controller 205 and or receiver 215 need to be programmed to omit a frequenc(y/ies) the AWiDD is utilizing. In some implementations, the AWiDD system operates on the ISM 2.4 GHz band at +19 dBm transmit power.

The controller 205 is at least MIL-STD-1316 and MIL-STD 810G compliant.

Turning to FIG. 4A, FIG. 4A is an image 400*a* of a controller and description of the controller form factor, according to an implementation of the present disclosure.

In some implementations, each controller 205:

Has a total weight 4.2 oz., 4.9" in length×2.1" in width× 1.06 in height.

Powered by two (2) each CR123 commercial off the shelf (COTS) non-rechargeable batteries and are "hot" swappable. Rechargeable batteries are also usable (e.g., RCR123A). All configured settings are stored within an EEPROM and will not be lost in the event of battery loss.

The controller 205 also possesses three (3) input buttons 405*a* for receiver selection and manipulation. A safety slider 410*a* covers fire buttons (not illustrated—refer to FIG. 4B) preventing premature detonation of selected receivers. The safety slider 410 also covers the input buttons 405*a* when the fire buttons are exposed preventing unintended manipulation of the input buttons 405*a*.

Figure 4B:
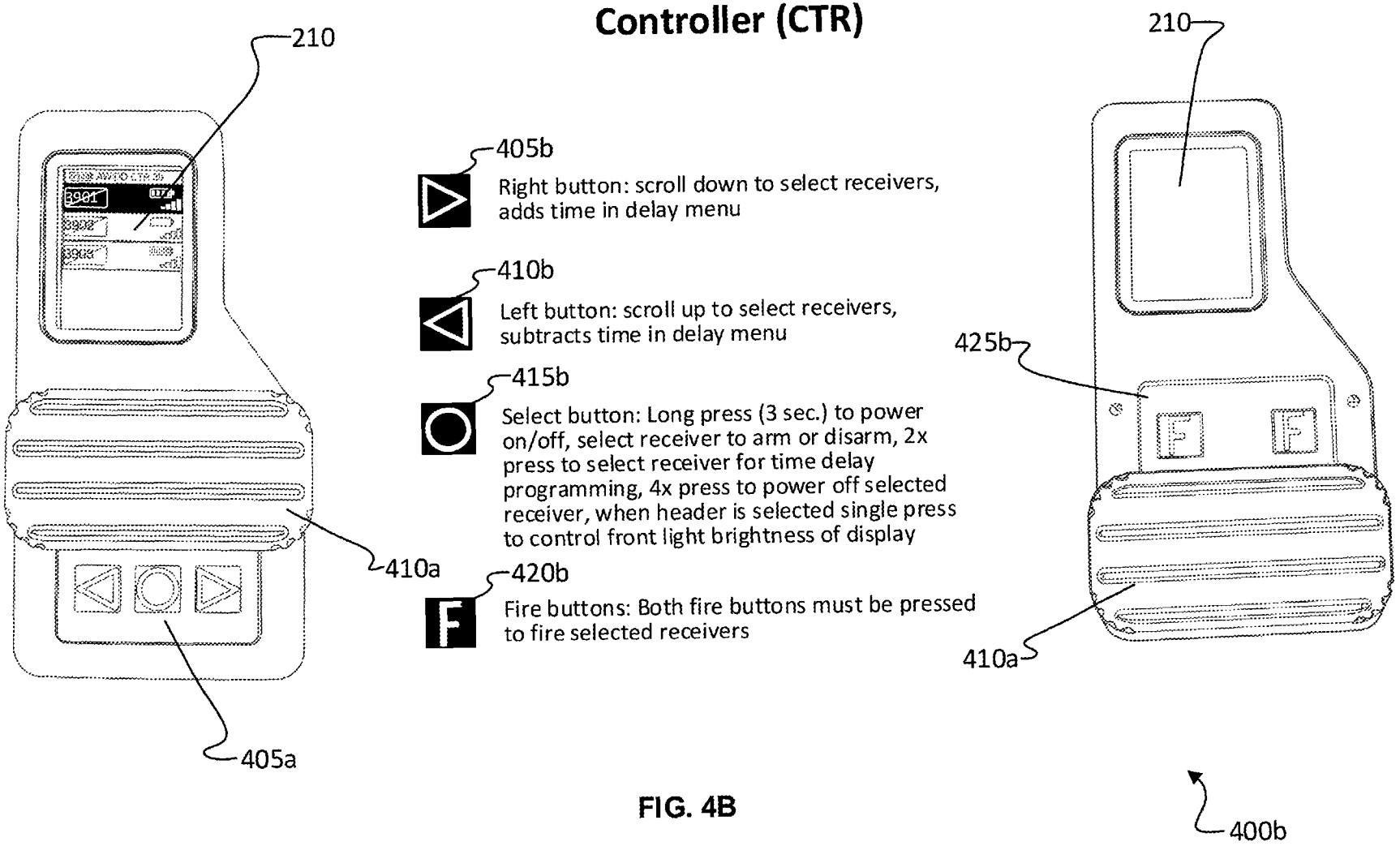
FIG. 4B is an image of a controller and description of the controller button functionality, according to an implementation of the present disclosure.

FIG. 4B is an image 400*b* of a controller and description of the controller button functionality, according to an implementation of the present disclosure.

With the safety slider 410*a* in the up position, the right button 405*b*, left button 410*b*, and select button 415*b* is exposed. In some implementations:

Right button 405*b*: scroll down to select receivers, adds time in delay menu.

Left button 410*b*: scroll up to select receivers, subtracts time in delay menu.

Select button 415*b*: Long press (3 sec.) to power on/off, select receiver to arm or disarm, 2× press to select receiver for time delay programming, 4× press to power off selected receiver, when header is selected single press to control front light brightness of display 210.

With the safety slider 410*a* in the down position, fire buttons 425*b* are exposed. In some implementations:

Fire buttons 425*b*: Both fire buttons must be pressed to initiate/fire selected receivers.

Returning to FIG. 2, in some implementations, display 210 can: 1) display controller 205 battery status; 2) display connected receivers 215; 3) arm/disarm receivers 215; 4) display receiver 215 battery status; and 5) display receiver 215 signal strength.

Figure 5:
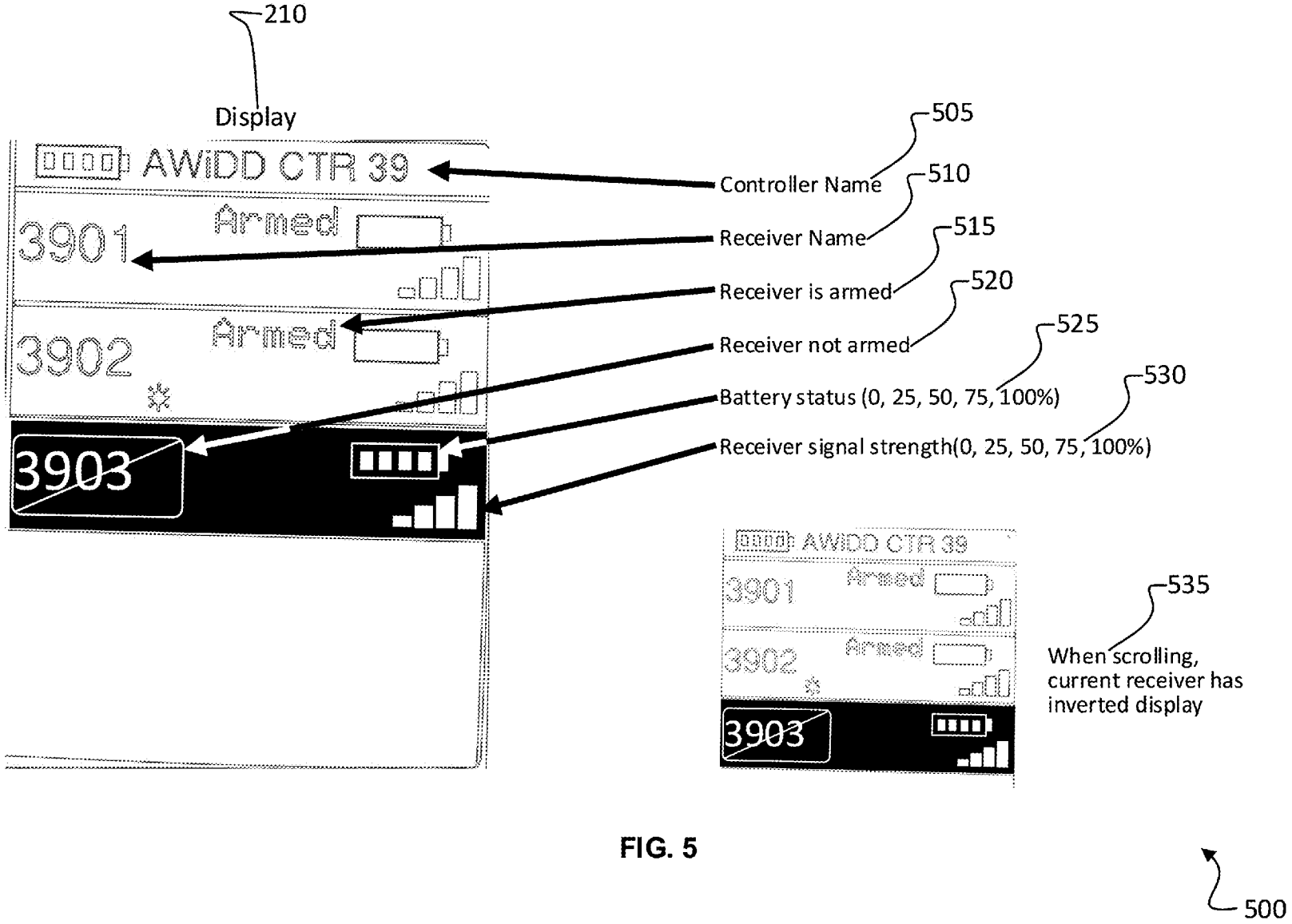
FIG. 5 is an image of a display of a controller, according to an implementation of the present disclosure.

Turning to FIG. 5, FIG. 5 is an image 500 of a display of a controller, according to an implementation of the present disclosure.

In some implementations, display 210 can display: 1) controller name 505; 2) receiver name 510; 3) receiver is armed 515; 4) receiver is not armed 520; 5) battery status (e.g., 0, 25, 50, 75, and 100%) 525; and 6) receiver signal strength (e.g., 1, 25, 50, 75, and 100%) 530. Display of both the receiver signal strength 530 as well as the battery status 525 and armed/disarmed state (515/520) of powered on receivers 215, can be used to confirm connection to a receiver 215 without premature detonation. For example, if the receiver 215 is displayed on the display 210, the connection is confirmed. In the event the receiver 215 loses connection, the display 210 will have a solid line through the receiver 215's last displayed state and will disappear from the display 210 after a period of five minutes.

In FIG. 5, display 210 only shows five (5) receivers 215 at a time and will only detonate displayed charges. "Armed" receivers 215 are moved up in the list as they are "Armed." Controller 205 can deselect receivers 215 from an "Armed" to an "Unarmed" status.

In some implementations, when scrolling, a current receiver 215 can be indicated with an inverted display 535. A built-in front light for display 210 can also be included with variable brightness levels.

Returning to FIG. 2, in some implementations, the controller 205 can be used to: 1) select receivers 220; 2) observe receiver status 225; 3) set a time delay 230; 4) power a receiver OFF 235; and 5) receive an indication that fire buttons have been pressed 240.

In some implementations, the controller 205 is configured to be programmed 245 by a mobile computing device. For example, an application installed on an IOS or ANDROID mobile smart phone can be used to program the controller 205.

Figure 6A:
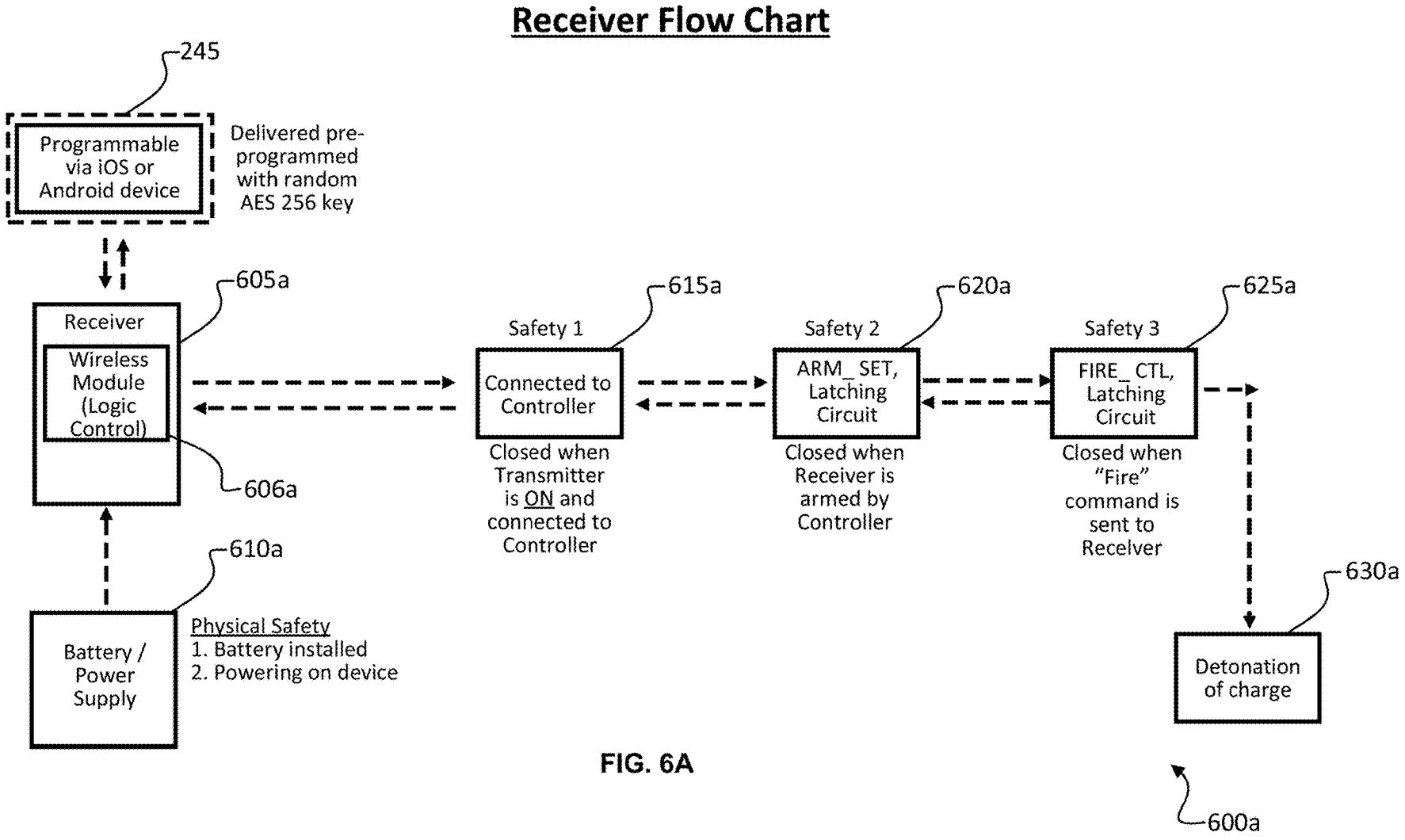
FIG. 6A is a block diagram of a receiver flow chart, according to an implementation of the present disclosure.

FIG. 6A is a block diagram of a receiver flow chart 600*a*, according to an implementation of the present disclosure. The receiver flow chart 600*a* includes a receiver 605*a* (e.g., a receiver 215) and wireless module (logic control) 606*a*, battery/power supply 610*a*, three hardware/software safeties (safety 1 615*a* (connected to receiver 605*a*), safety 2 620*a* (ARM, SET, Latching Circuit), and safety 3 625*a* (FIRE, CTL, Latching Circuit)), and detonation of charge 630*a*.

The receiver 605*a* is compatible with current department of defense (DoD) standard and non-standard shock tubes that connect directly to push connectors. Note, the horizonal, bi-directional arrows represent power between the safety circuits. Unless a safety circuit is closed (e.g., Safety 1 615*a*), power will not flow to safety circuits (e.g., Safety 2 620*a* and Safety 3 625*a*) that follow.

Receivers 605*a* have two (2) physical safeties 610*a* (i.e., a battery is installed and the receiver 605*a* powered on) allowing for safe charge construction and rapid employment. With respect to safety 1 615*a*, receivers 605*a* can only connect with a programmed controller 205 (e.g., utilizing 256 bit AES encryption) and the controller 205 must be ON. Safety 2 620 *a* is closed when the receiver is armed by the controller 205. Safety 3 625*a* is closed when a fire command is sent from the controller 205 to the receiver 605*a*. Once all three safeties are closed, a detonation of charge 630*a* connected to the receiver 605*a* can occur.

In some implementations, a user can set a variable time delay for individually selected receivers 605*a* using the controller 205. The variable time delay can be set in 1 second increments up to 10 seconds, 5 second increments from 10 seconds to 60 seconds, 30 second increments from 1 minute to 5 minutes, and 1 minute increments from 5 minutes to 10 minutes.

The receiver 605*a* can be test fired prior to employment to confirm operation. As previously described in FIG. 5, a controller display 210 can show both a signal strength 530 and battery status of the receiver 525. This information can be used to confirm connection to the receiver 605*a* without premature detonation.

In some implementations, an internal RF module in the wireless module (logic control) 606*a* of the receiver 605*a* can be configured with shielding to protect against RF interference. RF jammers within the vicinity of the controller 205 and/or receiver 605*a* need to be programmed to omit a frequenc(y/ies) the AWiDD is utilizing. In some implementations, the AWiDD system operates on the ISM 2.4 GHz band at +19 dBm transmit power.

Receivers 605*a* can be disarmed and powered OFF from the controller 205 for safe recovery and deconstruction of a charge.

In some implementations, each receiver 605 *a* can be configured with dual 3 mm push connect shock tube receptacles allowing dual priming.

The receiver 605*a* is at least MIL-STD-1316 and MIL-STD 810G compliant.

In some implementations, the receiver 605*a*/wireless module (logic control) 606*a* is configured to be programmed 245 by a mobile computing device. For example, an application installed on an IOS or ANDROID mobile smart phone can be used to program the receiver 605*a*/wireless module (logic control) 606*a*.

Figure 6B:
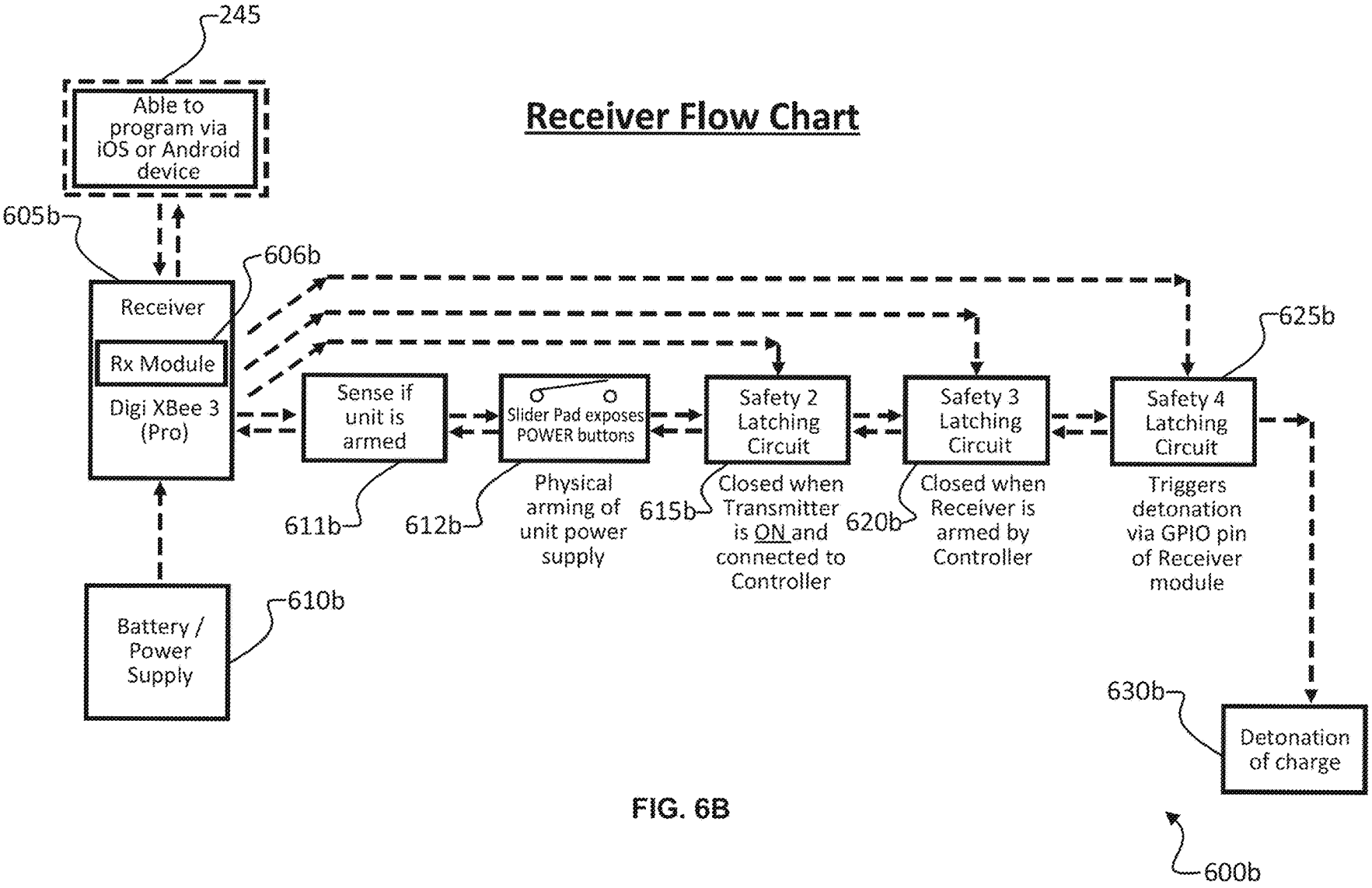
FIG. 6B is a block diagram of a receiver flow chart, according to an implementation of the present disclosure.

FIG. 6B is a block diagram of a receiver flow chart 600*b*, according to an implementation of the present disclosure. The receiver flow chart 600*b* includes a receiver 605*b* (e.g., a receiver 215), wireless transmission (Rx) module (logic control) 605*b*, battery/power supply 610*b*, an armed sensor function 611*b*, physical arming of unit power supply buttons 612*b*, three hardware/software safeties (safety 2 615*b* (connected to receiver 605*b*), safety 3 620*b* (ARM, SET, Latching Circuit), and safety 4 625*b* (FIRE, CTL, Latching Circuit)), and detonation of charge 630*b*.

The receiver 605*b* is compatible with current department of defense (DoD) standard and non-standard shock tubes that connect directly to push connectors. Note, the horizonal, bi-directional arrows represent power between the safety circuits. Unless a safety circuit is closed (e.g., Safety 1), power will not flow to safety circuits (e.g., Safety 2 620 and Safety 3 625) that follow.

Receivers 605*b* have two (2) physical safeties 610 (i.e., a battery is installed and the receiver 605*b* powered on) allowing for safe charge construction and rapid employment. Other safeties include the armed sensor function 611*b* and physical arming of power supply buttons 612*b*. With respect to the armed sensor function 611*b*, in some implementations, if a receiver 605*b* is already armed in a connected controller 205, the receiver 605*b* unit power supply cannot be physically armed (i.e., power will not flow to the power buttons 612*b*). Instead, the receiver 605*b* must be first disarmed in the connected controller 205. With respect to use of the arming of the unit power supply buttons 612*b* (refer to FIG. 7 702 and 704), the receiver 605*a* unit power supply is armed only if both physical power buttons are held down simultaneously.

Once the physical arming of the unit power supply is complete, with respect to safety 2 615*b*, receivers 605*b* can only connect with a programmed controller 205 (e.g., utilizing 256 bit AES encryption) and the controller 205 must be ON. Safety 3 620 *b* is closed when the receiver 605*b* is armed by the controller 205. Safety 4 625*b* is closed when a fire command is sent from the controller 205 to the receiver 605*b*. Once all three safeties are closed, a detonation of charge 630*b* connected to the receiver 605*b* can occur. In some implementations, the detonation of the charge 630*b* connected to the receiver 605*b* is performed using a general purpose input/output (GPIO) pin.

In some implementations, a user can set a variable time delay for individually selected receivers 605*b* using the controller 205. The variable time delay can be set in 1 second increments up to 10 seconds, 5 second increments from 10 seconds to 60 seconds, 30 second increments from 1 minute to 5 minutes, and 1 minute increments from 5 minutes to 10 minutes.

The receiver 605*b* can be test fired prior to employment to confirm operation. As previously described in FIG. 5, a controller display 210 can show both a signal strength 530 and battery status of the receiver 525. This information can be used to confirm connection to the receiver 605*b* without premature detonation.

In some implementations, an internal RF module in the wireless Rx module 606*b* of the receiver 605*b* can be configured with shielding to protect against RF interference. RF jammers within the vicinity of the controller 205 and/or receiver 605*b* need to be programmed to omit a frequenc (y/ies) the AWiDD is utilizing. In some implementations, the AWiDD system operates on the ISM 2.4 GHz band at +19 dBm transmit power.

Receivers 605*b* can be disarmed and powered OFF from the controller 205 for safe recovery and deconstruction of a charge.

In some implementations, each receiver 605*b* can be configured with dual 3 mm push connect shock tube receptacles allowing dual priming.

The receiver 605 *b* is at least MIL-STD-1316 and MIL-STD 810G compliant.

In some implementations, the receiver 605*b*/Rx module 606*b* is configured to be programmed 245 by a mobile computing device. For example, an application installed on an IOS or ANDROID mobile smart phone can be used to program the receiver 605*b*/Rx module 606*b*.

Figure 7:
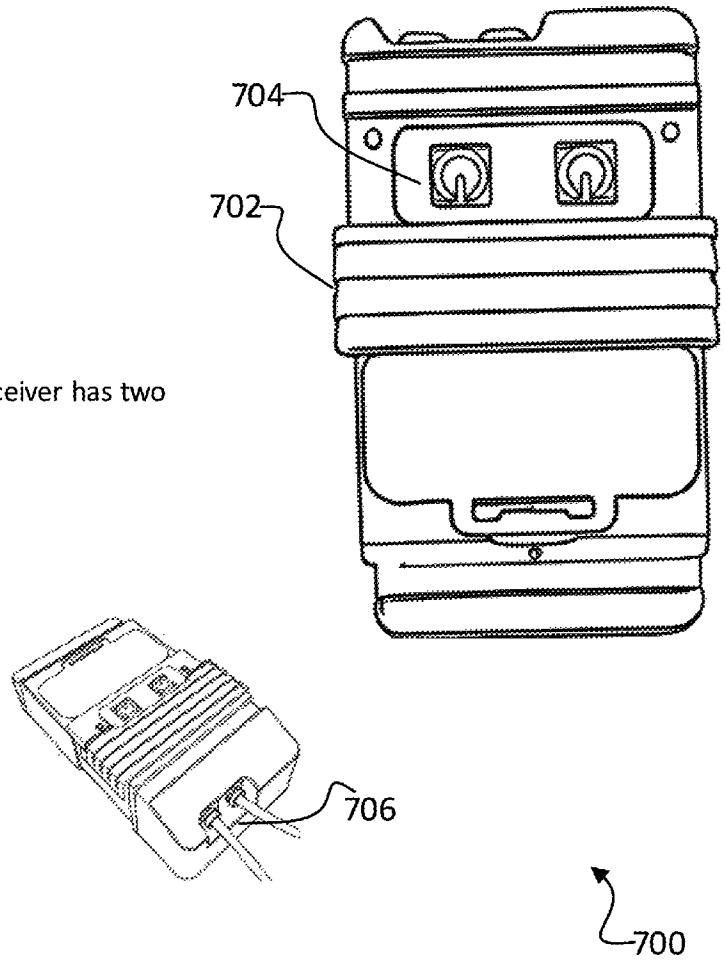
FIG. 7 is an image of a receiver and description of the receiver form factor, according to an implementation of the present disclosure.

FIG. 7 is an image 700 of a receiver and description of the receiver form factor, according to an implementation of the present disclosure.

In some implementations, the receiver 215 has a weight of 5.5 oz., is 3.0 inches in length×2.0 inches in width×1.28 inch in height.

A top safety slider 702 protects the power buttons 704. In some implementations, to power on the receiver 215, both power buttons 704 must be pressed and held for 3 seconds.

In some implementations, dual push connectors 706 permit 3 mm shot tubes to be installed. Each receiver 215 has two shock tube connectors 706 allowing dual priming.

Each receiver 215 can be configured with a 10-degree (or other angle) light-emitting diode (LED) (e.g., a red LED) to indicate status of the receiver (e.g., solid or blinking).

Figure 8:
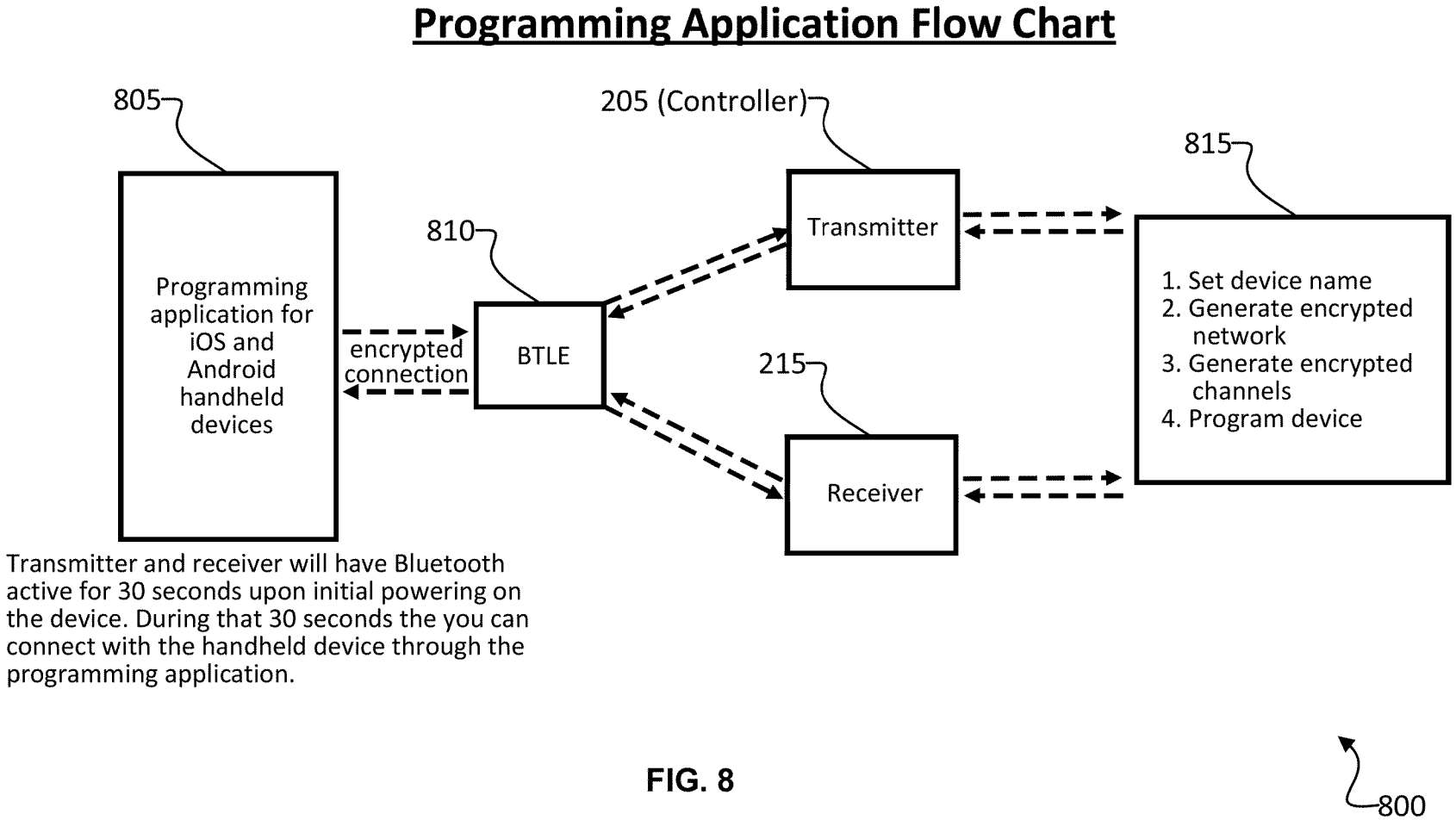
FIG. 8 is a block diagram of a programming application flow chart, according to an implementation of the present disclosure.

FIG. 8 is a block diagram of a programming application flow chart 800, according to an implementation of the present disclosure.

In some implementations, the controller 205 and receiver 215 are configured to be programmed 805 by a mobile computing device. For example, an application installed on an IOS or ANDROID mobile smart phone can be used to program the controller 205 using Bluetooth Low Energy (BTLE) 810. The controller 205 and receiver 215 can communicate with each other using BTLE 810.

For example, using the controller 205 and receiver 215: 1) a device name (e.g., the controller 205 and/or the receiver 215) can be set; 2) an encrypted network can be generated; 3) encrypted channels can be generated; and 4) devices (e.g., the controller 205 and/or the receiver 215) can be programmed.

Figure 9A:
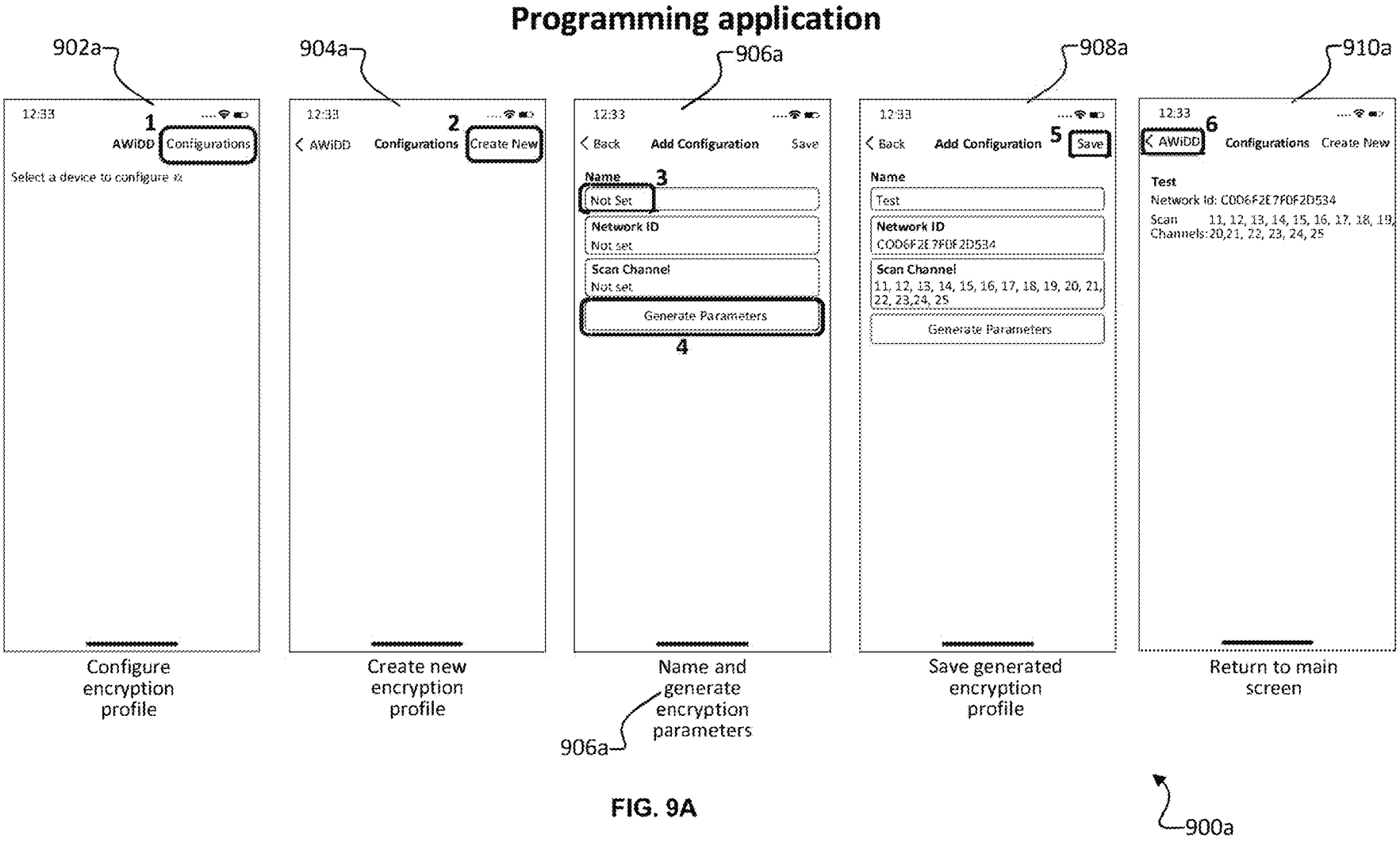
FIG. 9A illustrates a set of screenshots of an application used to program elements of an AWiDD, according to an implementation of the present disclosure.

FIG. 9A illustrates a set of screenshots 900*a* of an application used to program elements of an AWiDD, according to an implementation of the present disclosure.

In FIG. 9A, example programming screens illustrated include:

Configure encryption profile 902*a*,

Create new encryption profile 904*a*,

Name and generate encryption parameters 906*a*,

Save generated encryption profile 908*a*, and

Return to main screen 910*a*.

Figure 9B:
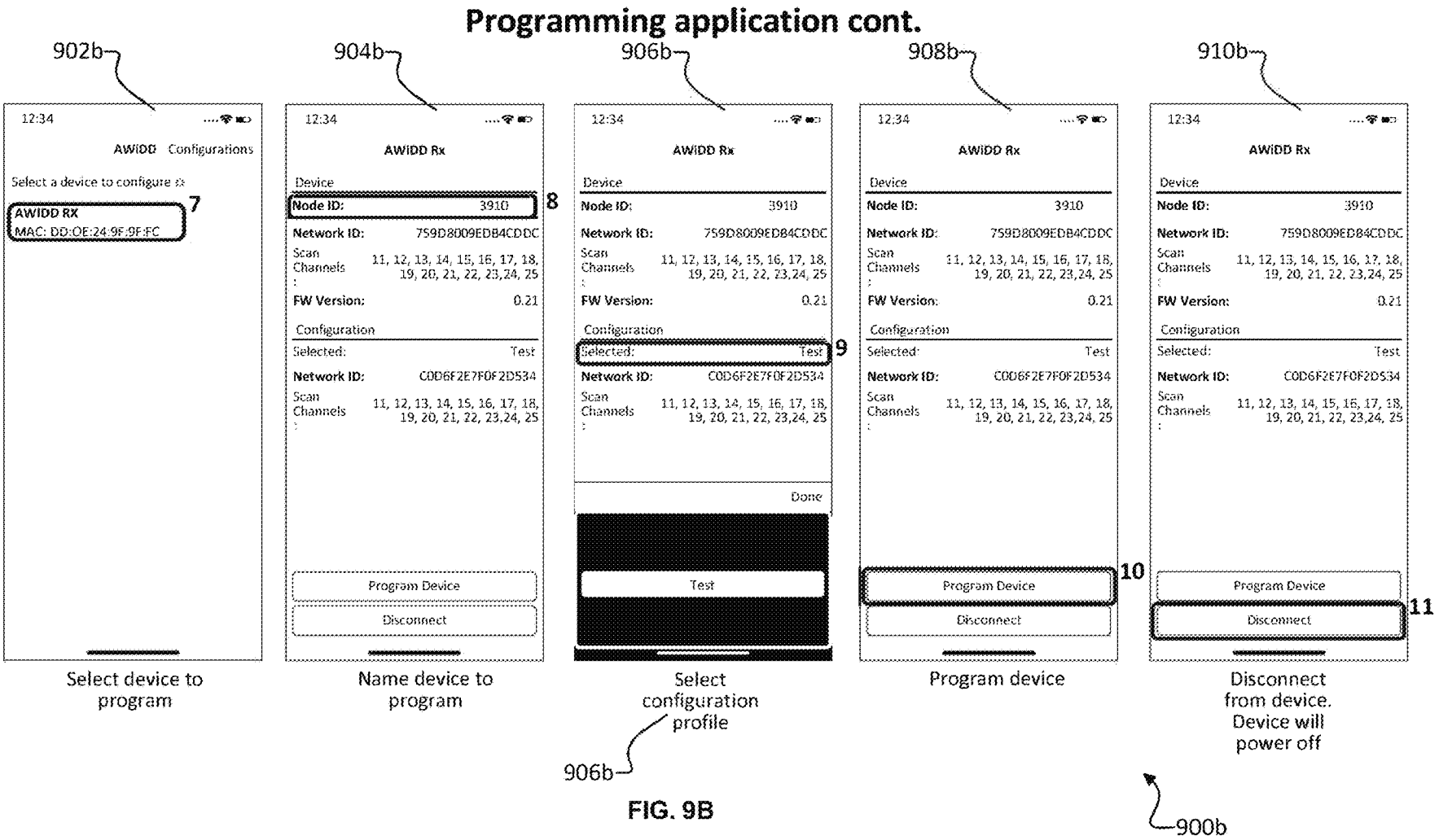
FIG. 9B illustrates a continuing set of screenshots of an application used to program elements of an AWiDD, according to an implementation of the present disclosure.

FIG. 9B illustrates a continuing set of screenshots 900*b* of an application used to program elements of an AWiDD, according to an implementation of the present disclosure.

In FIG. 9B, example programming screens illustrated include:

Select device to program 902*b*,

Name device to program 904*b*,

Select configuration profile 906*b*,

Program device 908*b*, and

Disconnect from device. Device will power off 910*b*.

Figure 10:
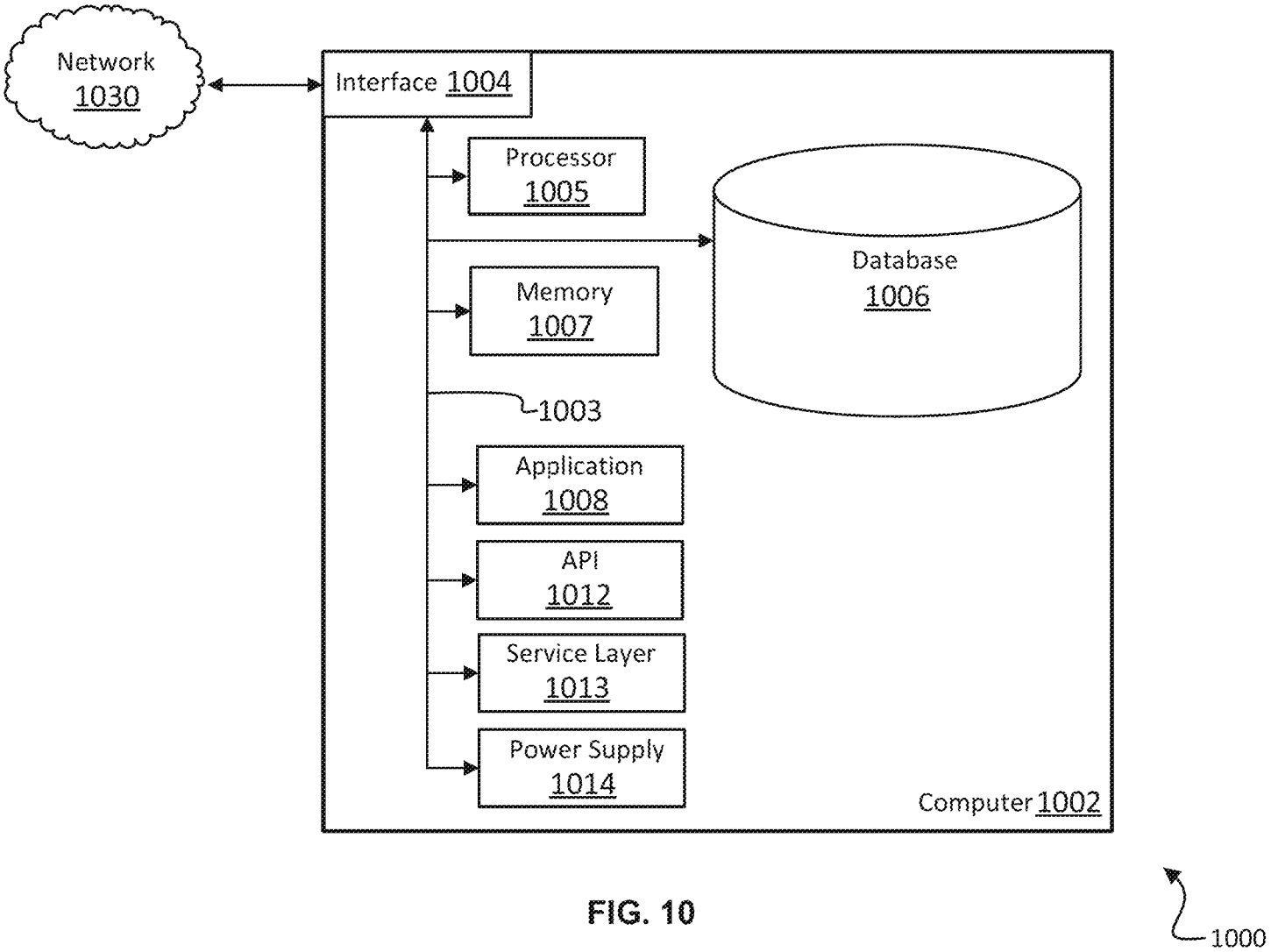
FIG. 10 is a block diagram illustrating an example of a computer-implemented system used to provide computational functionalities associated with described algorithms, methods, functions, processes, flows, and procedures, according to an implementation of the present disclosure.

FIG. 10 is a block diagram illustrating an example of a computer-implemented System 1000 used to provide computational functionalities associated with described algorithms, methods, functions, processes, flows, and procedures, according to an implementation of the present disclosure. In the illustrated implementation, computer-implemented system 1000 includes a Computer 1002 and a Network 1030.

The illustrated Computer 1002 is intended to encompass any computing device, such as a server, desktop computer, laptop/notebook computer, wireless data port, smart phone, personal data assistant (PDA), tablet computer, one or more processors within these devices, or a combination of computing devices, including physical or virtual instances of the computing device, or a combination of physical or virtual instances of the computing device. Additionally, the Computer 1002 can include an input device, such as a keypad, keyboard, or touch screen, or a combination of input devices that can accept user information, and an output device that conveys information associated with the operation of the Computer 1002, including digital data, visual, audio, another type of information, or a combination of types of information, on a graphical-type user interface (UI) (or GUI) or other UI.

The Computer 1002 can serve in a role in a distributed computing system as, for example, a client, network component, a server, or a database or another persistency, or a combination of roles for performing the subject matter described in the present disclosure. The illustrated Computer 1002 is communicably coupled with a Network 1030. In some implementations, one or more components of the Computer 1002 can be configured to operate within an environment, or a combination of environments, including cloud-computing, local, or global.

At a high level, the Computer 1002 is an electronic computing device operable to receive, transmit, process, store, or manage data and information associated with the described subject matter. According to some implementations, the Computer 1002 can also include or be communicably coupled with a server, such as an application server, e-mail server, web server, caching server, or streaming data server, or a combination of servers.

The Computer 1002 can receive requests over Network 1030 (for example, from a client software application executing on another Computer 1002) and respond to the received requests by processing the received requests using a software application or a combination of software applications. In addition, requests can also be sent to the Computer 1002 from internal users (for example, from a command console or by another internal access method), external or third-parties, or other entities, individuals, systems, or computers.

Each of the components of the Computer 1002 can communicate using a System Bus 1003. In some implementations, any or all of the components of the Computer 1002, including hardware, software, or a combination of hardware and software, can interface over the System Bus 1003 using an application programming interface (API) 1012, a Service Layer 1013, or a combination of the API 1012 and Service Layer 1013. The API 1012 can include specifications for routines, data structures, and object classes. The API 1012 can be either computer-language independent or dependent and refer to a complete interface, a single function, or even a set of APIs. The Service Layer 1013 provides software services to the Computer 1002 or other components (whether illustrated or not) that are communicably coupled to the Computer 1002. The functionality of the Computer 1002 can be accessible for all service consumers using the Service Layer 1013. Software services, such as those provided by the Service Layer 1013, provide reusable, defined functionalities through a defined interface. For example, the interface can be software written in a computing language (for example JAVA or C++) or a combination of computing languages, and providing data in a particular format (for example, extensible markup language (XML)) or a combination of formats. While illustrated as an integrated component of the Computer 1002, alternative implementations can illustrate the API 1012 or the Service Layer 1013 as stand-alone components in relation to other components of the Computer 1002 or other components (whether illustrated or not) that are communicably coupled to the Computer 1002. Moreover, any or all parts of the API 1012 or the Service Layer 1013 can be implemented as a child or a sub-module of another software module, enterprise application, or hardware module without departing from the scope of the present disclosure.

The Computer 1002 includes an Interface 1004. Although illustrated as a single Interface 1004, two or more Interfaces 1004 can be used according to particular needs, desires, or particular implementations of the Computer 1002. The Interface 1004 is used by the Computer 1002 for communicating with another computing system (whether illustrated or not) that is communicatively linked to the Network 1030 in a distributed environment. Generally, the Interface 1004 is operable to communicate with the Network 1030 and includes logic encoded in software, hardware, or a combination of software and hardware. More specifically, the Interface 1004 can include software supporting one or more communication protocols associated with communications such that the Network 1030 or hardware of Interface 1004 is operable to communicate physical signals within and outside of the illustrated Computer 1002.

The Computer 1002 includes a Processor 1005. Although illustrated as a single Processor 1005, two or more Processors 1005 can be used according to particular needs, desires, or particular implementations of the Computer 1002. Generally, the Processor 1005 executes instructions and manipulates data to perform the operations of the Computer 1002 and any algorithms, methods, functions, processes, flows, and procedures as described in the present disclosure.

The Computer 1002 also includes a Database 1006 that can hold data for the Computer 1002, another component communicatively linked to the Network 1030 (whether illustrated or not), or a combination of the Computer 1002 and another component. For example, Database 1006 can be an in-memory or conventional database storing data consistent with the present disclosure. In some implementations, Database 1006 can be a combination of two or more different database types (for example, a hybrid in-memory and conventional database) according to particular needs, desires, or particular implementations of the Computer 1002 and the described functionality. Although illustrated as a single Database 1006, two or more databases of similar or differing types can be used according to particular needs, desires, or particular implementations of the Computer 1002 and the described functionality. While Database 1006 is illustrated as an integral component of the Computer 1002, in alternative implementations, Database 1006 can be external to the Computer 1002. The Database 1006 can hold and operate on at least any data type mentioned or any data type consistent with this disclosure.

The Computer 1002 also includes a Memory 1007 that can hold data for the Computer 1002, another component or components communicatively linked to the Network 1030 (whether illustrated or not), or a combination of the Computer 1002 and another component. Memory 1007 can store any data consistent with the present disclosure. In some implementations, Memory 1007 can be a combination of two or more different types of memory (for example, a combination of semiconductor and magnetic storage) according to particular needs, desires, or particular implementations of the Computer 1002 and the described functionality. Although illustrated as a single Memory 1007, two or more Memories 1007 or similar or differing types can be used according to particular needs, desires, or particular implementations of the Computer 1002 and the described functionality. While Memory 1007 is illustrated as an integral component of the Computer 1002, in alternative implementations, Memory 1007 can be external to the Computer 1002.

The Application 1008 is an algorithmic software engine providing functionality according to particular needs, desires, or particular implementations of the Computer 1002, particularly with respect to functionality described in the present disclosure. For example, Application 1008 can serve as one or more components, modules, or applications. Further, although illustrated as a single Application 1008, the Application 1008 can be implemented as multiple Applications 1008 on the Computer 1002. In addition, although illustrated as integral to the Computer 1002, in alternative implementations, the Application 1008 can be external to the Computer 1002.

The Computer 1002 can also include a Power Supply 1014. The Power Supply 1014 can include a rechargeable or non-rechargeable battery that can be configured to be either user- or non-user-replaceable. In some implementations, the Power Supply 1014 can include power-conversion or management circuits (including recharging, standby, or another power management functionality). In some implementations, the Power Supply 1014 can include a power plug to allow the Computer 1002 to be plugged into a wall socket or another power source to, for example, power the Computer 1002 or recharge a rechargeable battery.

There can be any number of Computers 1002 associated with, or external to, a computer system containing Computer 1002, each Computer 1002 communicating over Network 1030. Further, the term "client," "user," or other appropriate terminology can be used interchangeably, as appropriate, without departing from the scope of the present disclosure. Moreover, the present disclosure contemplates that many users can use one Computer 1002, or that one user can use multiple computers 1002.

Described implementations of the subject matter can include one or more features, alone or in combination.

For example, in a first implementation, a multi-atmospheric safe firing control circuit for wireless detonators and initiators, comprising: a low-voltage switch, wherein the low-voltage switch can transition from an open state to a closed state; an oscillating circuit, wherein the oscillating circuit activates when the low-voltage switch transitions to the closed state, and wherein the oscillating circuit provides alternating current to primary coils of a transformer; a doubling circuit coupled to a capacitor, wherein the doubling circuit receives direct current from secondary coils of the transformer, and wherein the doubling circuit multiples voltage for storage in the capacitor; and a gas discharge tube coupled to the capacitor, wherein the gas discharge tube acts as a high-voltage switch by completing a voltage transfer from the capacitor to coupled electrical contacts upon reaching a preset voltage threshold.

The foregoing and other described implementations can each, optionally, include one or more of the following features:

A first feature, combinable with any of the following features, wherein the preset voltage threshold is 1600V.

A second feature, combinable with any of the previous or following features, wherein the coupled electrical contacts comprise a pair of electrical contacts for use in dual priming applications.

A third feature, combinable with any of the previous or following features, wherein the coupled electrical contacts are coupled to an electrical detonator or a non-electrical detonator.

A fourth feature, combinable with any of the previous or following features, wherein the non-electrical detonator is a blasting cap.

A fifth feature, combinable with any of the previous or following features, wherein the non-electrical detonator is a NONEL shock tube.

A sixth feature, combinable with any of the previous or following features, wherein the electrical detonator is a spark gap probe.

A seventh feature, combinable with any of the previous or following features, wherein the spark gap probe is used to ignite a non-electrical detonator.

Some implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable medium for execution by, or to control the operation of, a computer or computer-implemented system. Alternatively, or additionally, the program instructions can be encoded in/on an artificially generated propagated signal, for example, a machine-generated electrical, optical, or electromagnetic signal that is generated to encode information for transmission to a receiver apparatus for execution by a computer or computer-implemented system. The computer-storage medium can be a machine-readable storage device, a machine-readable storage substrate, a random or serial access memory device, or a combination of computer-storage mediums. Configuring one or more computers means that the one or more computers have installed hardware, firmware, or software (or combinations of hardware, firmware, and software) so that when the software is executed by the one or more computers, particular computing operations are performed. The computer storage medium is not, however, a propagated signal.

The term "real-time," "real time," "realtime," "real (fast) time (RFT)," "near(ly) real-time (NRT)," "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second(s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus," "computer," "computing device," or "electronic computer device" (or an equivalent term as understood by one of ordinary skill in the art) refer to data processing hardware and encompass all kinds of apparatuses, devices, and machines for processing data, including by way of example, a programmable processor, a computer, or multiple processors or computers. The computer can also be, or further include special-purpose logic circuitry, for example, a central processing unit (CPU), a field-programmable gate array (FPGA), or an application-specific integrated circuit (ASIC). In some implementations, the computer or computer-implemented system or special-purpose logic circuitry (or a combination of the computer or computer-implemented system and special-purpose logic circuitry) can be hardware- or software-based (or a combination of both hardware- and software-based). The computer can optionally include code that creates an execution environment for computer programs, for example, code that constitutes processor firmware, a protocol stack, a database management system, an operating system, or a combination of execution environments. The present disclosure contemplates the use of a computer or computer-implemented system with an operating system, for example LINUX, UNIX, WINDOWS, MAC OS, ANDROID, or IOS, or a combination of operating systems.

A computer program, which can also be referred to or described as a program, software, a software application, a unit, a module, a software module, a script, code, or other component can be written in any form of programming language, including compiled or interpreted languages, or declarative or procedural languages, and it can be deployed in any form, including, for example, as a stand-alone program, module, component, or subroutine, for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network.

While portions of the programs illustrated in the various figures can be illustrated as individual components, such as units or modules, that implement described features and functionality using various objects, methods, or other processes, the programs can instead include a number of sub-units, sub-modules, third-party services, components, libraries, and other components, as appropriate. Conversely, the features and functionality of various components can be combined into single components, as appropriate. Thresholds used to make computational determinations can be statically, dynamically, or both statically and dynamically determined.

Described methods, processes, or logic flows represent one or more examples of functionality consistent with the present disclosure and are not intended to limit the disclosure to the described or illustrated implementations, but to be accorded the widest scope consistent with described principles and features. The described methods, processes, or logic flows can be performed by one or more programmable computers executing one or more computer programs to perform functions by operating on input data and generating output data. The methods, processes, or logic flows can also be performed by, and computers can also be implemented as, special-purpose logic circuitry, for example, a CPU, an FPGA, or an ASIC.

Computers for the execution of a computer program can be based on general or special-purpose microprocessors, both, or another type of CPU. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable memory storage device, for example, a universal serial bus (USB) flash drive, to name just a few.

Non-transitory computer-readable media for storing computer program instructions and data can include all forms of permanent/non-permanent or volatile/non-volatile memory, media and memory devices, including by way of example semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices; magnetic devices, for example, tape, cartridges, cassettes, internal/removable disks; magneto-optical disks; and optical memory devices, for example, digital versatile/video disc (DVD), compact disc (CD)-ROM, DVD+/−R, DVD-RAM, DVD-ROM, high-definition/density (HD)-DVD, and BLU-RAY/BLU-RAY DISC (BD), and other optical memory technologies. The memory can store various objects or data, including caches, classes, frameworks, applications, modules, backup data, jobs, web pages, web page templates, data structures, database tables, repositories storing dynamic information, or other appropriate information including any parameters, variables, algorithms, instructions, rules, constraints, or references. Additionally, the memory can include other appropriate data, such as logs, policies, security or access data, or reporting files. The processor and the memory can be supplemented by, or incorporated in, special-purpose logic circuitry.

To provide for interaction with a user, implementations of the subject matter described in this specification can be implemented on a computer having a display device, for example, a cathode ray tube (CRT), liquid crystal display (LCD), light emitting diode (LED), or plasma monitor, for displaying information to the user and a keyboard and a pointing device, for example, a mouse, trackball, or trackpad by which the user can provide input to the computer. Input can also be provided to the computer using a touchscreen, such as a tablet computer surface with pressure sensitivity or a multi-touch screen using capacitive or electric sensing. Other types of devices can be used to interact with the user. For example, feedback provided to the user can be any form of sensory feedback (such as, visual, auditory, tactile, or a combination of feedback types). Input from the user can be received in any form, including acoustic, speech, or tactile input. In addition, a computer can interact with the user by sending documents to and receiving documents from a client computing device that is used by the user (for example, by sending web pages to a web browser on a user's mobile computing device in response to requests received from the web browser).

The term "graphical user interface (GUI) can be used in the singular or the plural to describe one or more graphical user interfaces and each of the displays of a particular graphical user interface. Therefore, a GUI can represent any graphical user interface, including but not limited to, a web browser, a touch screen, or a command line interface (CLI) that processes information and efficiently presents the information results to the user. In general, a GUI can include a number of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11x or other protocols, all or a portion of the Internet, another communication network, or a combination of communication networks. The communication network can communicate with, for example, Internet Protocol (IP) packets, frame relay frames, Asynchronous Transfer Mode (ATM) cells, voice, video, data, or other information between network nodes.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of any inventive concept or on the scope of what can be claimed, but rather as descriptions of features that can be specific to particular implementations of particular inventive concepts. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features can be described as acting in certain combinations and even initially claimed as such, one or more features from a claimed combination can, in some cases, be excised from the combination, and the claimed combination can be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations can be considered optional), to achieve desirable results. In certain circumstances, multitasking or parallel processing (or a combination of multitasking and parallel processing) can be advantageous and performed as deemed appropriate.

The separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the scope of the present disclosure.

Furthermore, any claimed implementation may be applicable to a computer-implemented method; a non-transitory, computer-readable medium storing computer-readable instructions to perform the computer-implemented method; and/or a computer system comprising a computer memory interoperably coupled with a hardware processor configured to perform the computer-implemented method or the instructions stored on the non-transitory, computer-readable medium.

What is claimed is:

1. A multi-atmospheric safe firing control circuit for wireless detonators and initiators, comprising:

a low-voltage switch, wherein the low-voltage switch can transition from an open state to a closed state;

an oscillating circuit, wherein the oscillating circuit activates when the low-voltage switch transitions to the closed state, and wherein the oscillating circuit provides alternating current to primary coils of a transformer;

a doubling circuit coupled to a capacitor, wherein the doubling circuit receives direct current from secondary coils of the transformer, and wherein the doubling circuit multiples voltage for storage in the capacitor; and a gas discharge tube coupled to the capacitor, wherein the gas discharge tube acts as a high-voltage switch by completing a voltage transfer from the capacitor to coupled electrical contacts upon reaching a preset voltage threshold.

2. The multi-atmospheric safe firing control circuit for wireless detonators and initiators of claim 1, wherein the preset voltage threshold is 1600V.

3. The multi-atmospheric safe firing control circuit for wireless detonators and initiators of claim 1, wherein the coupled electrical contacts comprise a pair of electrical contacts for use in dual priming applications.

4. The multi-atmospheric safe firing control circuit for wireless detonators and initiators of claim 1, wherein the coupled electrical contacts are coupled to an electrical detonator or a non-electrical detonator.

5. The multi-atmospheric safe firing control circuit for wireless detonators and initiators of claim 4, wherein the non-electrical detonator is a blasting cap.

6. The multi-atmospheric safe firing control circuit for wireless detonators and initiators of claim 4, wherein the non-electrical detonator is a NONEL shock tube.

7. The multi-atmospheric safe firing control circuit for wireless detonators and initiators of claim 4, wherein the electrical detonator is a spark gap probe.

8. The multi-atmospheric safe firing control circuit for wireless detonators and initiators of claim 7, wherein the spark gap probe is used to ignite a non-electrical detonator.

* * * * *